US011149906B2

(12) United States Patent
Frenal et al.

(10) Patent No.: US 11,149,906 B2
(45) Date of Patent: Oct. 19, 2021

(54) VALVE, PRESSURIZED FLUID CONTAINER, AND FILLING AND WITHDRAWAL METHODS

(71) Applicant: L'Air Liquide, Société Anonyme pour l'Etude et l'Exploitation des Procédés Georges Claude, Paris (FR)

(72) Inventors: Antoine Frenal, Ezanville (FR); Denis Muller, Rueil Malmaison (FR); Herve Paoli, Rueil Malmaison (FR)

(73) Assignee: L'Air Liquide, Société Anonyme pour l'Etude et l'Exploitation des Procédés Georges Claude, Paris (FR)

( * ) Notice: Subject to any disclaimer, the term of this patent is extended or adjusted under 35 U.S.C. 154(b) by 0 days.

(21) Appl. No.: 16/816,633

(22) Filed: Mar. 12, 2020

(65) Prior Publication Data

US 2020/0292135 A1 Sep. 17, 2020

(30) Foreign Application Priority Data

Mar. 12, 2019 (FR) ..... 1902484

(51) Int. Cl.
*F17C 13/04* (2006.01)
*F17C 5/00* (2006.01)
*F17C 7/00* (2006.01)

(52) U.S. Cl.
CPC ..... *F17C 13/04* (2013.01); *F17C 5/00* (2013.01); *F17C 7/00* (2013.01); *F17C 2205/0323* (2013.01)

(58) Field of Classification Search
CPC .... F17C 13/04; F17C 5/00; F17C 7/00; F17C 2205/0323
USPC ..... 141/11
See application file for complete search history.

(56) References Cited

U.S. PATENT DOCUMENTS 4,655,246 A * 4/1987 Phlipot ..... F17C 13/04 137/505.11
4,802,505 A * 2/1989 Gemignani ..... F15B 13/042 137/492
7,237,570 B2 * 7/2007 Gamard ..... F16K 1/305 137/556

(Continued)

FOREIGN PATENT DOCUMENTS

EP 1 382 899 1/2004
EP 1 530 002 5/2005

(Continued)

OTHER PUBLICATIONS

French Search Report for corresponding FR 1902484, dated Nov. 5, 2019.

*Primary Examiner* — Timothy L Maust
*Assistant Examiner* — James R Hakomaki
(74) *Attorney, Agent, or Firm* — Elwood L. Haynes

(57) ABSTRACT

Valve including a body delimiting an internal fluid withdrawal and possibly fluid filling circuit, the said internal circuit extending between an upstream end configured to be placed in communication with the storage volume of a tank and a downstream end configured to be connected to a user member withdrawing or distributing the pressurized fluid via the internal circuit, the valve (having, placed in series from upstream to downstream in the internal circuit between the upstream end and the downstream end: an upstream valve shutter, an isolation valve shutter and a dust valve shutter.

8 Claims, 7 Drawing Sheets

(56) References Cited

U.S. PATENT DOCUMENTS

| | | | | |
|---|---|---|---|---|
| 2012/0006445 | A1* | 1/2012 | Frenal | B67D 7/02 141/1 |
| 2014/0048169 | A1* | 2/2014 | Pisot | F17C 5/06 141/4 |
| 2014/0174594 | A1 | 6/2014 | Frenal et al. | |
| 2015/0276064 | A1* | 10/2015 | Balmforth | F16K 24/02 137/613 |
| 2015/0276132 | A1* | 10/2015 | Roberge | F17C 13/04 137/485 |
| 2016/0258540 | A1* | 9/2016 | Germani | F16K 3/32 |
| 2017/0002981 | A1* | 1/2017 | Carron | F17C 1/00 |
| 2017/0002982 | A1* | 1/2017 | Carron | F17C 13/025 |
| 2017/0030809 | A1* | 2/2017 | Knight | B01L 3/5082 |
| 2017/0114961 | A1* | 4/2017 | Baune | F17C 13/04 |
| 2017/0259027 | A1* | 9/2017 | De Villemeur | F17C 1/00 |
| 2018/0024575 | A1* | 1/2018 | De Potter | F16K 37/005 137/98 |
| 2018/0038551 | A1* | 2/2018 | Frenal | F17C 1/00 |
| 2019/0353263 | A1* | 11/2019 | John | F16K 31/42 |
| 2019/0368661 | A1* | 12/2019 | Paoli | F17C 13/04 |

FOREIGN PATENT DOCUMENTS

| | | |
|---|---|---|
| FR | 2 962 519 | 1/2012 |
| FR | 2 962 521 | 1/2012 |
| FR | 2 978 432 | 2/2013 |
| FR | 3 033 386 | 9/2016 |

* cited by examiner

[Fig. 1]
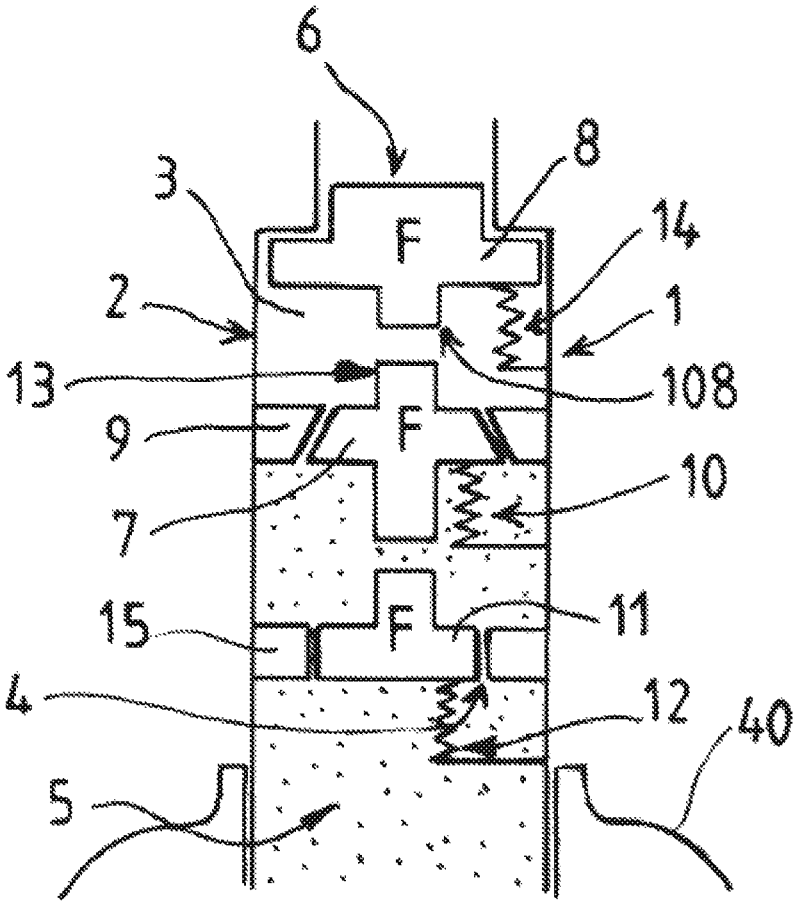
[Fig. 2]
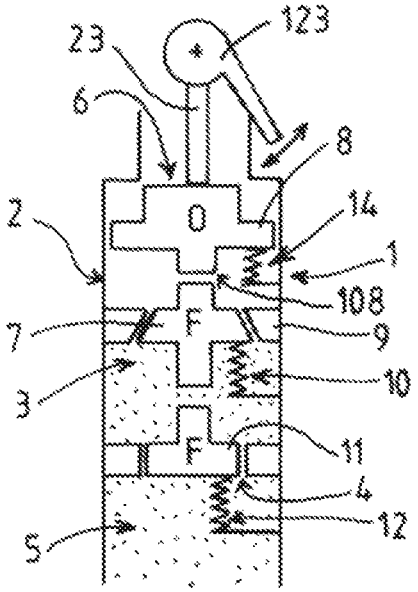

[Fig. 3]
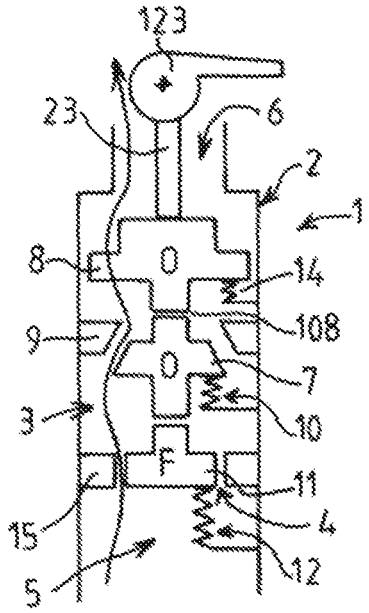
[Fig. 4]
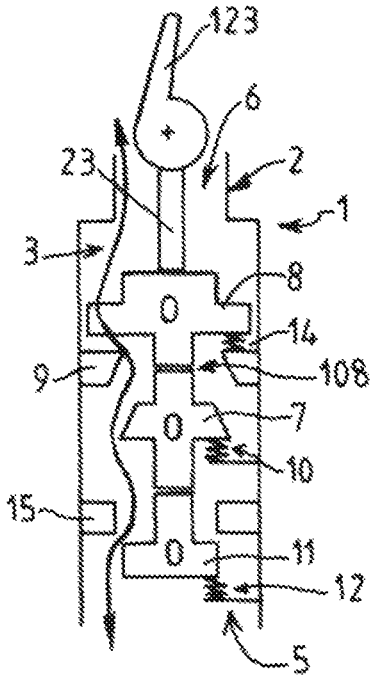

[Fig. 5]
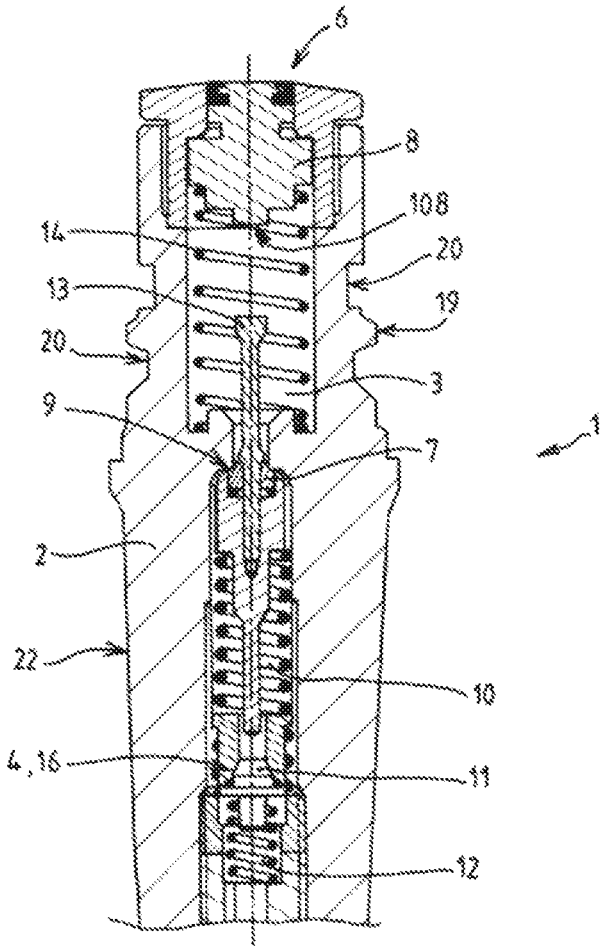

[Fig. 6]
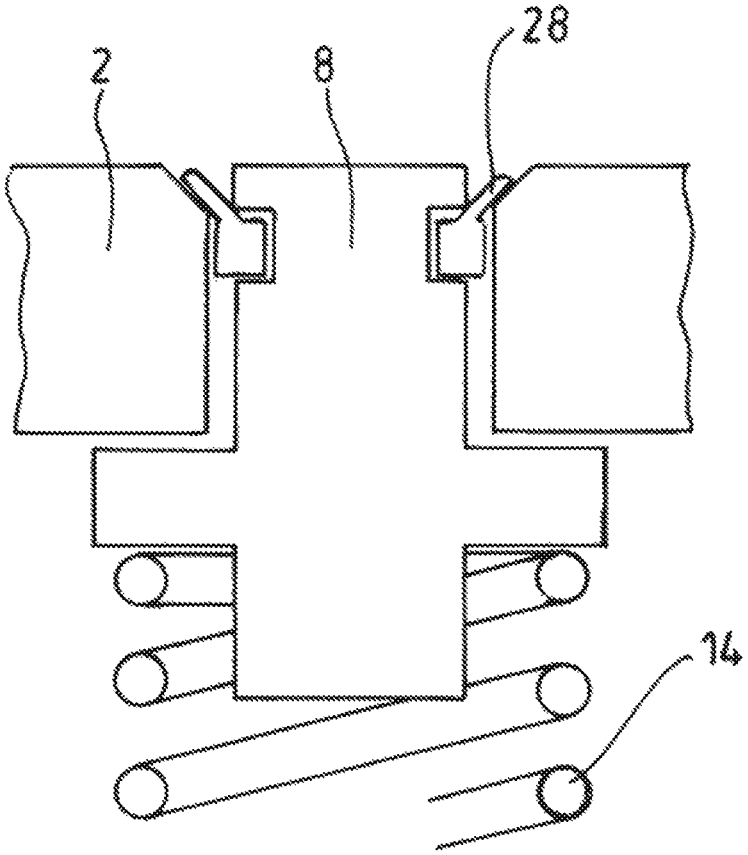

[Fig. 7]
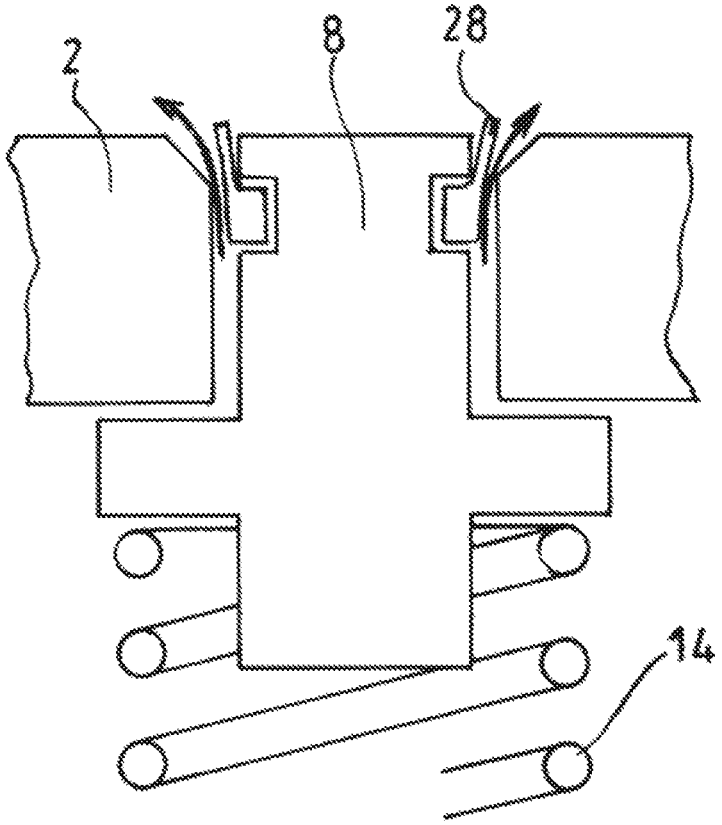

[Fig. 8]
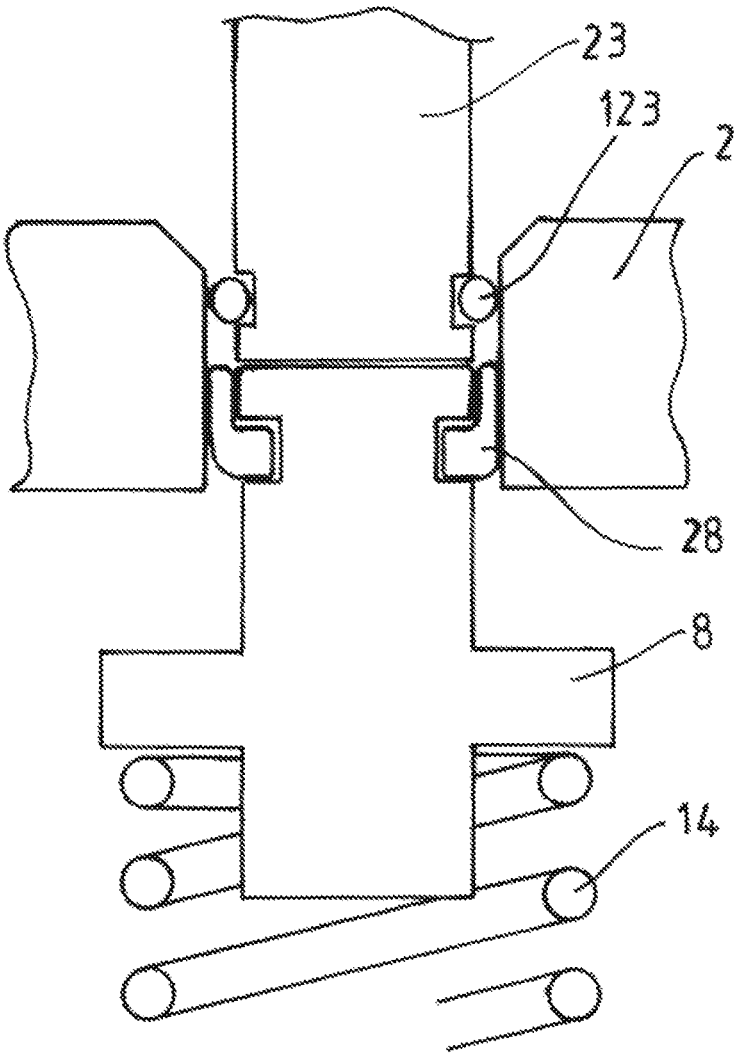

[Fig. 9]
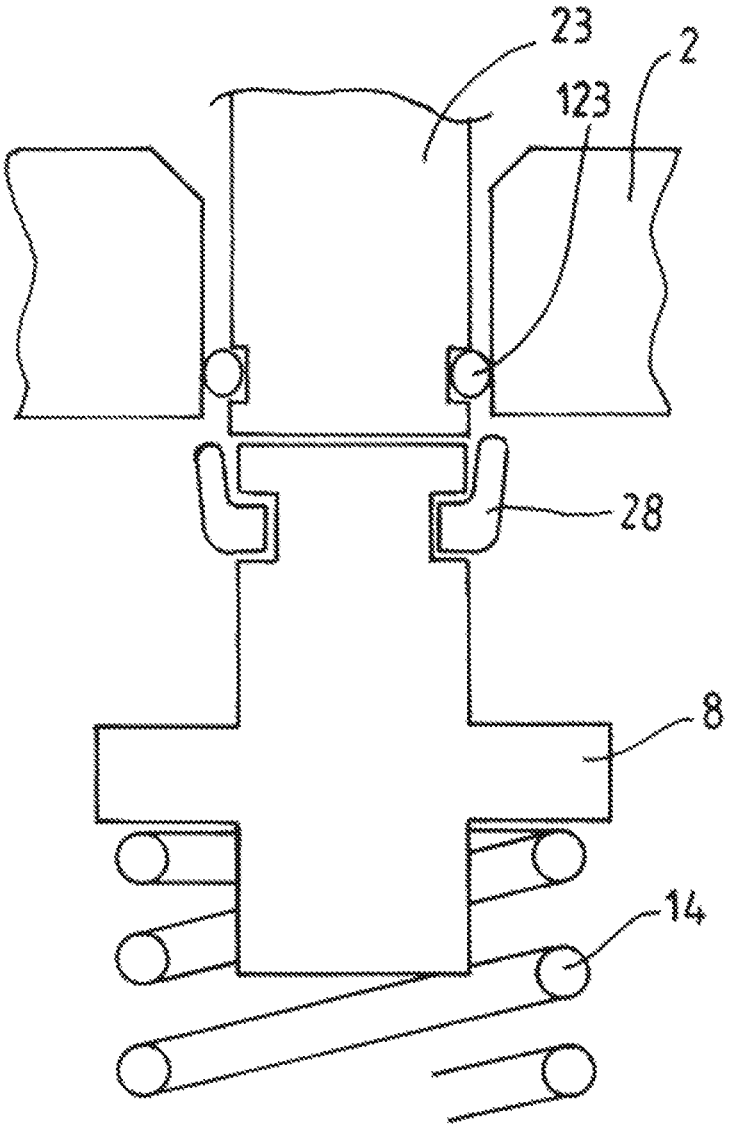

VALVE, PRESSURIZED FLUID CONTAINER, AND FILLING AND WITHDRAWAL METHODS

CROSS REFERENCE TO RELATED APPLICATIONS

This application claims the benefit of priority under 35 U.S.C. § 119 (a) and (b) to French Patent Application No. 1902484, filed Mar. 12, 2019, the entire contents of which are incorporated herein by reference.

BACKGROUND

The invention relates to a valve, to a pressurized fluid container and to filling and withdrawal methods.

The invention relates more particularly to a valve comprising a body delimiting an internal fluid withdrawal and possibly fluid filling circuit, the said internal circuit extending between an upstream end intended to be placed in communication with the storage volume of a tank and a downstream end intended to be connected to a user member withdrawing or distributing the pressurized fluid via the internal circuit, the valve comprising, placed in series from upstream to downstream in the internal circuit between the upstream end and the downstream end: an upstream valve shutter, an isolation valve shutter and a dust valve shutter, the dust valve shutter being able to move relative to the body between a position in which the upstream end of the circuit is closed and at least two distinct open positions, when the dust valve shutter is in the closed position, the isolation valve shutter and the upstream valve shutter being in respective positions in which the circuit is closed, in the at least two respective distinct open positions of the dust valve shutter, either only the isolation valve shutter being in a position in which the circuit is open or, respectively, the isolation valve shutter and the upstream valve shutter being in positions in which the circuit is open.

Valves comprising multiple valve shutters in series are known (cf. for example FR2962519A or FR3033386A).

Sudden opening of a valve of a high-pressure fluid tank may generate dangerous pressure increases (risks of damage to and/or of ejections of the downstream systems and risk of fire, notably in the case of oxygen).

Flow-restricting systems are known but are not easily compatible with a complex architecture involving numerous valve shutters requiring the ability to allow high flow rates (filling and/or withdrawal).

SUMMARY

One object of the present invention is to alleviate all or some of the above-mentioned drawbacks of the prior art.

To this end, the valve according to the invention, in other respects in accordance with the generic definition thereof given in the above preamble, is essentially characterized in that the valve comprises a calibrated orifice defining a determined opening allowing gas to pass between upstream and downstream of the upstream valve shutter when the latter is in its position in which the circuit is closed, said determined opening of the calibrated orifice being smaller than the opening produced when the upstream valve shutter is in its position in which the circuit is open.

This architecture makes it possible to provide a flow restricting system upstream of the main isolation valve shutter with the possibility of overriding it in order to allow maximum flow rate.

Furthermore, embodiments of the invention may comprise one or more of the following features:

- the calibrated orifice delimits an opening having a first determined cross section whereas the opening produced when the upstream valve shutter is in its position in which the circuit is open has a second determined cross section, the ratio between the first cross section and the second cross section being comprised between 1/100 and 1/20 and preferably 1/80 and 1/30,
- the isolation valve shutter is able to move relative to a seat between a downstream position in which the circuit is closed and at least one upstream position in which the circuit is open, the said isolation valve shutter being urged towards its downstream position by a return member, the dust valve shutter comprising an upstream end and being able to move relative to the body between a downstream position in which the upstream end of the circuit is closed and at least one upstream position in which the downstream end of the circuit is closed, the said dust valve shutter being urged towards its downstream position by a return member, the upstream valve shutter being able to move relative to a seat between a downstream position in which the circuit is closed and at least one upstream position in which the circuit is open, the upstream valve shutter being urged towards its downstream closed position by a return member,
- the dust valve shutter is able to move from its downstream closed position towards: a first determined upstream position referred to as the "contactless" position opening the downstream end of the circuit, in which position the downstream end of the dust valve shutter does not push against the isolation valve shutter, or a second determined upstream position referred to as the "contacting" position opening the downstream end of the circuit, in which position the upstream end of the dust valve shutter pushes on a downstream end of the mobile isolation valve shutter in order, through contact, to move the isolation valve shutter off its seat towards a first upstream position in which the circuit is open in which position the isolation valve shutter does not push on the upstream valve shutter, or a third determined upstream position opening the downstream end of the circuit, in which position the upstream end of the dust valve shutter pushes on the downstream end of the mobile isolation valve shutter to move the isolation valve shutter off its seat towards a second upstream position in which the circuit is open, in which position the isolation valve shutter pushes the upstream valve shutter into its position in which the upstream end of the circuit is open,
- the calibrated orifice is delimited at least in part by the upstream valve shutter or an element thereof,
- the calibrated orifice is housed in the upstream valve shutter,
- the calibrated orifice comprises a shutter such as a ball pushed towards a seat by a return member, the shutter bearing non-sealingly on the seat,
- the dust valve shutter is a residual pressure valve shutter maintaining a minimum pressure in the circuit when it is in the closed position and allowing gas to be discharged from the circuit in the event of an overpressure above a determined pressure threshold,
- the valve comprises a deformable seal situated on the dust valve shutter and/or on the body and able and configured to remove excess pressure in the circuit above a determined threshold to be discharged to the outside, but remaining in a closed and sealed position when the pressure in the circuit is below this threshold.

The invention also relates to container for pressurized fluid, particularly a pressurized-gas cylinder or collection of cylinders, comprising a valve according to any one of the features above or below.

The invention also relates to a method for filling such a pressurized-fluid container using a filling/withdrawal connector mechanically connected to the body of the valve removably, the method comprising a step of moving the dust valve shutter from upstream towards downstream into a determined downstream so-called "filling" position opening the downstream end of the circuit, in which position the dust valve shutter pushes against a downstream end of the mobile isolation valve shutter and moves the valve shutter towards an upstream position in which the circuit is open, the upstream valve shutter is also moved into a position in which the upstream end of the circuit is open so as to allow fluid to be transferred from downstream to upstream into the container, According to other possible particular features:

- in its upstream "filling" position, the dust valve shutter pushes on a downstream end of the mobile isolation valve shutter and through contact moves the isolation valve shutter into a determined open position in which the isolation valve shutter in its turn pushes the upstream valve shutter into a position in which the downstream end of the circuit is open so as to allow fluid to be transferred from downstream to upstream into the container,
- the dust valve shutter is moved in the upstream direction by a mechanical action of one end of a mobile valve driver belonging to the filling/withdrawal connector.

The invention also relates to a method for withdrawing pressurized fluid from such a pressurized-fluid container by means of a filling/withdrawal connector mechanically connected to the body of the valve removably, the method comprising a first step of moving the dust valve shutter from downstream towards upstream into a first open position opening the downstream end of the circuit, in which position the dust valve shutter pushes on the mobile isolation valve shutter in order through contact to move the isolation valve shutter towards a position in which the circuit is open, in which position the isolation valve shutter does not push on the upstream valve shutter, so as to allow fluid in the circuit to be withdrawn from upstream towards downstream through the calibrated orifice.

According to other possible particular features:

- the method comprises a second step of moving the dust valve shutter from downstream towards upstream into a second open position opening the downstream end of the circuit, in which position the dust valve shutter pushes on the mobile isolation valve shutter to move the isolation valve shutter towards a position in which the circuit is open, in which position the isolation valve shutter pushes the upstream valve shutter into its open position so as to allow fluid in the circuit to be withdrawn from upstream towards downstream without being restricted to the opening of the calibrated orifice,
- the first and the second step of moving the dust valve shutter from downstream towards upstream into the first and second open positions respectively are performed in sequence to ensure progressive opening of the circuit.

The invention may also relate to any alternative device or method comprising any combination of the features above or below within the scope of the claims.

BRIEF DESCRIPTION OF THE DRAWINGS

For a further understanding of the nature and objects for the present invention, reference should be made to the following detailed description, taken in conjunction with the accompanying drawings, in which like elements are given the same or analogous reference numbers and wherein:

FIG. 1 depicts a schematic and partial view in section, illustrating the structure of a valve mounted on a tank according to one exemplary embodiment of the invention in a closed first configuration (all three valve shutters closed), FIG. 2 depicts the valve of FIG. 1 connected to a filling/withdrawal tool equipped with an actuating member and in a second configuration (only dust valve shutter open), in accordance with another embodiment of the current invention, FIG. 3 depicts the assembly of FIG. 2 in a third configuration (two valve shutters open while the third is closed but the circuit is partially open via a calibrated orifice), in accordance with another embodiment of the current invention, FIG. 4 depicts the assembly of FIG. 2 in a fourth configuration (all three valve shutters fully open), in accordance with another embodiment of the current invention, FIG. 5 depicts a schematic and partial view in section, illustrating one example of a structure of a valve in the configuration of FIG. 1, in accordance with another embodiment of the current invention, FIG. 6 depicts a schematic and partial view in section of a detail of a valve illustrating one possible embodiment of a dust valve shutter in a closed first configuration, in accordance with another embodiment of the current invention, FIG. 7 depicts a view similar to that of FIG. 6 in which the dust valve shutter is in a second configuration which is closed, but provides pressure regulation, in accordance with another embodiment of the current invention, FIG. 8 depicts a view similar to that of FIG. 6 in which the dust valve shutter is moved from its closed first configuration towards an open configuration via a valve-driver stem, in accordance with another embodiment of the current invention, FIG. 9 depicts a view similar to that of FIG. 8 in which the dust valve shutter is in an open configuration under the action of the valve-driver stem, in accordance with another embodiment of the current invention.

DETAILED DESCRIPTION OF PREFERRED EMBODIMENTS

With reference to FIGS. 1 and 5, the valve 1 comprises a body 2 delimiting an internal fluid filling and withdrawal circuit 3.

The internal circuit 3 extends between a downstream end 6 intended to be connected to a user member withdrawing or distributing pressurized fluid via the internal circuit 3 and an upstream end 5 intended to be placed in communication with the storage volume of one or more pressurized-fluid tanks 40.

As a preference, the internal circuit 3 extends along a longitudinal axis. Likewise, the body 2 preferably extends along a longitudinal axis and has an oblong, for example cylindrical, overall shape.

The valve 1 comprises, positioned in series in the internal circuit 3 from downstream 6 towards upstream, a dust valve shutter 8, an isolation valve shutter 7 and an upstream valve shutter 11.

Each valve preferably comprises a respective shutter able to move relative to a respective seat 9, 15. In addition, each mobile shutter can be urged by a respective return member 14, 10, 12, such as a spring, towards a position in which the internal circuit 3 is closed.

Thus, the isolation valve shutter 7 is capable of translational movement relative to its seat 9 between a downstream position in which the circuit 3 is closed and at least one upstream position in which the circuit 3 is open. The isolation valve shutter 7 is urged towards its downstream position by a return member 10 such as a spring.

The dust valve shutter 8 comprises an upstream end 108 and is positioned downstream of the isolation valve shutter 7. The dust valve shutter 8 is able to move relative to the body 2 between a downstream position in which the downstream end of the circuit 3 is closed and at least one upstream position in which the downstream end of the circuit 3 is open. The dust valve shutter 8 is urged towards its downstream position by a return member 14 such as a spring.

As depicted in FIG. 1 and in FIG. 5, in a situation of rest (no external influence), the three valve shutters 8, 7, 11 are in their position in which the circuit 3 is closed.

Advantageously and as detailed hereinafter, the valve 1 comprises a calibrated orifice 4 defining a determined opening allowing gas to pass between the upstream and downstream of the upstream valve shutter 11 when the latter is in its position in which the circuit 3 is closed. This determined opening of the calibrated orifice 4 is, however, smaller than the opening produced when the upstream valve shutter 11 is in its position in which the circuit 3 is open.

The dust valve shutter 8 is able to be moved from its downstream closed position into a first determined upstream position referred to as the "contactless" position opening the downstream end of the circuit 3, in which position the upstream end 108 of the dust valve shutter 8 does not push against the isolation valve shutter 7 (no contact with the isolation valve shutter 7) cf. FIG. 2.

This position may be obtained for example by connecting a filling and/or withdrawal tool 123 to the downstream end of the body 2 of the valve 1. For example, the tool 123 comprises a mobile valve driver member 23 which moves the dust valve shutter 8 slightly from downstream towards upstream. As indicated schematically, the valve driver 23 can be moved for example via a pivoting lever that can be operated manually, hydraulically, pneumatically, electrically or using any other appropriate actuating member.

This contactless position exhibits numerous advantages. Thus, this configuration in which only the dust valve shutter 8 is open allows a filling and/or withdrawal tool to be connected sealingly to the downstream end of the valve 1 with a force that remains constant whatever the pressure level upstream of the isolation valve shutter 7. Specifically, the pressure upstream of the dust valve shutter 8 can be the same as on the outside of the valve (ambient atmospheric pressure), particularly when the dust valve shutter 8 is closing the downstream end 6 of the circuit 3 non-sealingly.

In addition, this contactless configuration also allows a filling/withdrawal tool to perform leak tests on the isolation valve shutter 7. The filling/withdrawal tool is connected sealingly to the end 6 of the valve and can be configured to create a vacuum (depression) in the downstream part of the circuit 3 (downstream of the isolation valve shutter 7). This means that one or more tests can be conducted in order to verify/qualify the level of sealing of the valve shutter 7 and of the tool, for example before subjecting the mechanism to high pressures.

The dust valve shutter 8 is able to be moved further in the upstream direction into a second determined upstream position referred to as the "contacting" position opening the downstream end 6 of the circuit 3, in which position the upstream end 108 of the dust valve shutter 8 pushes against a downstream end of the isolation valve shutter 7. The isolation valve shutter 7 is then moved, by contact, off its seat 9 towards a first upstream position in which the circuit 3 is open, in which position the isolation valve shutter 7 does not push against the upstream third valve shutter 11 (cf. FIG. 3).

In this position, the pressurized fluid can escape towards the downstream end according to the flow rate imposed by the calibrated orifice 4.

What that means to say is that, in this case, the first two valve shutters 8, 7 are mechanically opened whereas the upstream third valve shutter 11 is in the closed position but a calibrated flow rate can nevertheless escape.

This, configuration corresponds to the start of withdrawal via a progressive opening of the circuit making it possible to control a progressive increase in pressure downstream (circulation of fluid indicated schematically by an arrow in FIG. 3).

The dust valve shutter 8 can be moved even further in the upstream direction into a third determined upstream position that opens the circuit 3. In this position, the upstream end 108 of the dust valve shutter 8 pushes against a downstream end of the mobile isolation valve shutter 7 in order through contact to move the isolation valve shutter 7 off its seat 9 towards a second upstream position in which the circuit 3 is open. In this position, the isolation valve shutter 7 pushes the upstream valve shutter 11 into a position in which the upstream end of the circuit 3 is fully open. What that means to say is that in this case, all three valve shutters 8, 7, 11 are fully open, allowing maximum fluid flow.

This configuration corresponds to a state of filling of or of withdrawal from a tank 40 through the valve 1 (cf. FIG. 4 in which a double-ended arrow symbolizes the case of a filling or of a withdrawal).

What that means to say is that, in the configuration of FIG. 4, if a user attempts to fill the tank (by injecting pressurized gas from upstream 6 towards downstream) the nonreturn mechanism will cause the upstream valve shutter 11 to close. In particular, the pressure of the gas from downstream 6 towards upstream 5 will generate on the upstream valve shutter 11 a force in the direction of the closure of this valve shutter.

The nonreturn (NRV) mechanism may comprise a mechanism of the same type as the one described in document FR3033386A.

FIG. 5 illustrates in greater detail one possible and non-limiting exemplary embodiment of a valve.

The valve 1 has a body 2 of essentially or predominantly cylindrical shape. A first zone of the body 2 (on the downstream side 6) comprises a cylindrical portion defining on the exterior surface of the body 2 one or more grooves 19 and/or one or more ribs 20.

This portion 18 forms an impression intended to collaborate in mechanical fastening with a determined mating attachment member (claw(s) and/or system involving balls or the like . . . ) belonging to a filling/withdrawal member 123 (cf. for example FIG. 2). This portion thus makes it possible to error-proof or provide decoding between the valve 1 (and therefore the gas of the tank to which it is connected) and the corresponding filling or withdrawal module 123.

Upstream of this first portion, the body 2 may preferably comprise a zone intended to collaborate with a mounting tool (for example a spanner) for mounting it on a tank. This interface preferably has a number of faces and is for example hexagonal so as to collaborate with a tightening tool and be capable of withstanding the tightening torque needed for correct retention of the body on a tank.

Further upstream still, the body 2 may comprise a threaded zone 22 for connecting the valve 1 into the tapped thread of a gas cylinder 40 for example.

The body 2 comprises a central internal longitudinal canal forming the internal circuit 3, The dust valve shutter 8 situated at the downstream end 6 of the circuit 3 is preferably a sealed valve shutter, sealing for example via a seal borne by the mobile valve shutter 8 and collaborating with the fixed peripheral part of the body 2. As a preference also, the dust valve shutter 8 lies flush (is situated in the same plane as the downstream end 6 of the body 2) in the closed position. In this way, the risk of collecting water, dust or dirt is avoided or at least reduced thanks to the dust valve shutter 8.

The isolation valve shutter 8 may comprise a central end 108 projecting upstream and allowing collaboration with the adjacent isolation valve shutter 7. For example, this end 108 may collaborate with a downstream end 13 of the isolation valve shutter 7.

The return member 10 for the isolation valve shutter 7 may be mounted around part of this valve shutter 7.

Further upstream, the upstream valve shutter 11 is urged against a seat 15 by a return member 12.

The valve has a calibrated orifice which allows a limited passage of gas across the upstream valve shutter 11 even when this valve shutter is in the closed position.

As a preference, the calibrated orifice 4 delimits an opening having a first determined cross section S1 whereas the opening produced when the upstream valve shutter 11 is in its position in which the circuit 3 is open has a second determined cross section S2 such that the ratio between the first cross section S1 and the second cross section S2 is comprised between 1/100 and 1/20 and preferably 1/80 and 1/30.

The passage (first cross section of opening S1) of the calibrated orifice can be obtained by impairing the line of sealing between the upstream valve shutter 11 and its seat 15 by broaching, or by a stroke with a saw or some other tool on the valve shutter or on its seat. The valve shutter 11 cannot be perfectly cylindrical (faceted ball, porous ball, or any other shape that allows the gas to pass at a limited flow rate).

Another alternative or cumulative solution is to place a calibrated orifice in parallel with this upstream valve shutter 11 in order to provide the limited passage of gas. Alternatively, this calibrated orifice may pass through the body of the upstream valve shutter 11.

This structure allows the following opening sequence:

First of all, a filling/withdrawal tool may be mechanically connected to the downstream end of the valve. Mechanical retention and external sealing may be established between the tool and the valve 1.

Next, a partial opening of the circuit may be achieved by opening the dust valve shutter 8 and the isolation valve shutter 7 by virtue of the calibrated orifice 4. This achieves a progressive rise in pressure downstream.

Next, the upstream valve shutter 11 can be opened for maximum flow rate.

This sequence can be used equally well for filling as for withdrawal.

The travel of the valve shutter or valve shutters, the length of the gas pipe and the calibrated restricted flow rate can be adapted to encourage a progressive rise in system pressure upon opening.

The operating element (lever or the like) that operates the valve driver 23 of the tool may be configured to sequence these various steps (partial or complete opening of the circuit 3).

This architecture allows a sweeping of the circuit in the downstream direction (so-called "flush" jet).

According to one advantageous particular feature (independent of the foregoing or in combination with the foregoing), the dust valve shutter 8 may form a residual-pressure valve shutter maintaining a minimum pressure in the circuit when it is in the closed position.

For example, the dust valve shutter 8 itself and/or a seal that it bears and/or a seal of the valve body with which it collaborates is able to deform so that an excess of pressure in the circuit above a determined threshold (for example above 200 mbar and up to 10 bar or more notably 15 bar or 20 bar or more, notably between 200 mbar and six to eight bar, for example 1 to 6 bar) can be discharged to the outside, but remains in the closed and sealed position when the pressure in the circuit is below this threshold. In this way, the residual-pressure valve shutter maintains a pressure above atmospheric pressure in the circuit when the dust valve shutter 8 is in the closed position.

This affords the advantage of maintaining a residual pressure in the valve whatever the steps of connection to the valve. In addition, it makes it possible to achieve a function of maintaining residual pressure that does not present any problem of whistling or any risk of failing to recluse through the absence of dynamic sealing with a valve opening member. Furthermore, it makes it possible to maintain a self-regulated residual pressure the maximum value of which does not impair the ergonomics of the connection (the residual pressure multiplied by the bearing surface area being lower than the force required for connection).

One advantage of maintaining the residual pressure is that it prevents any risk of ingress of contamination coming from outside while supplementing the protection afforded by the seal 28 and the valve shutter 8 itself.

One possible exemplary embodiment is illustrated in FIG. 6, FIG. 7, FIG. 8 and FIG. 9.

Thus, the dust valve shutter 8 may comprise a mobile piston equipped with a groove housing an annular seal 28 in contact with a bore in which the piston slides. In the storage position, the piston is kept in the up position by a return member such as a spring 14.

The seal 28 could of course be overmoulded and/or vulcanized onto the piston.

In FIG. 6 the dust valve shutter 8 is in the closed position (the storage position for example). The dust valve shutter 8 comprises a peripheral O-ring seal 28 forming a lip that presses sealingly against the circular border of the orifice formed in the body 2 of the valve. For example, the lip faces upwards (towards the outlet of the valve 1).

In this configuration, contact between the seal 28 of the dust valve shutter 8 and the bore delimiting its passage orifice provides sealing against the gas which ensures that the upstream chamber of the dust valve shutter 8 is not in communication with the air. The seal 28 can deform under the effect of the pressure inside (upstream of the dust valve shutter 8) so as to expel the excess pressure to the outside.

In FIG. 7 the dust valve shutter 8 is in the closed position but allows excess gas to be discharged to the outside of the valve 1 (position of storage with pressure discharge). The end of the seal 28 is pushed back by the excess pressure upstream, sealing is interrupted to allow discharge of gas only. As soon as the pressure drops back below the opening threshold, the seal reverts to its sealed closed position described earlier. Thus, this measured opening is possible only in the direction of discharge and under certain conditions regarding the pressure differential between the inside (between upstream of the dust valve shutter 8) and the outside. As a preference, the seal 28 is elastic enough that it can return to its initial position after having discharged the excess pressure, allowing its sealing against gas to be recovered. The pressure gradient between the gas contained in the chamber and the outside ensures that the volume of the chamber is not contaminated with ambient air.

In FIG. 8 the dust valve shutter 8 is pushed back upstream (towards the inside of the valve 1) by a valve-driver stem 23 which may comprise a peripheral seal 123 providing sealing against the circuit of the valve at the inlet orifice. The dust valve shutter 8 may also possess a seal against the body 2 of the valve.

Upon complete connection (complete movement of the dust valve shutter), the seal 28 of the dust valve shutter 8 may be positioned on the piston in such a way that contact between the seal 28 of the dust valve shutter 8 and the bore is interrupted only after sealed contact has been established between the seal 23 of the stem 123 and the bore of the valve. Thus, the act of connecting, to the valve, a member bearing the valve driver 23, does not place the volume of gas of the chamber situated upstream of the dust valve shutter 8 in contact with the air.

If a module (a valve or the like) is connected sealingly to the downstream end 6 and this module is provided with a residual pressure valve (RPV) shutter function, then a positive pressure prevails in the connection even after the circuit downstream has been purged. Thus, the above sequence makes it possible to ensure simultaneous sealing of the two seals (28 and 123). This architecture makes it possible to maintain a positive pressure in the chamber upstream of the dust valve shutter 8 as soon as the module is disconnected. There is no need to wait for "natural leakage" from the isolation valve shutter 7 in order to enjoy this novel feature.

In FIG. 9 the dust valve shutter 8 has reached the open position (sealing against the body of the valve interrupted).

In this open position, the position of the piston of the dust valve shutter 8, the travel of the valve driver 23 present in the valve 1 and the position of the various seals (28 and 123) are preferably such that the seal 28 of the dust valve shutter 8 is never in contact either with the bore that delimits the orifice or with the body of the valve. That makes it possible to avoid trapping pressurized gas.

When gas is withdrawn (from upstream to downstream), the gas can flow towards the downstream of the dust valve shutter 8 by means for example of one or more orifices present in or around the valve driver 23 or any other suitable component. For example, orifices may be provided radially notably in the case where activation of the opening/closing function occurs independently. According to another possibility, a drilling coaxial with the valve driver stem 23 may be provided, along which gas can pass.

Upon disconnection of the valve drive member 23 (and of the valve which bears it), the reverse movement occurs in the direction of closure. The seal 28 of the dust valve shutter 8 and the seal 123 of the stem 23 may be positioned in such a way that contact between the seal 28 of the dust valve shutter 8 and the bore 2 becomes established before sealed contact between the seal 123 of the valve driver stem 23 and the bore of the dust cap is lost. This too makes it possible to avoid contaminating the circuit upstream of the dust valve 8.

According to this solution, the problems of whistling and of failure to recluse which are encountered with known residual pressure valve shutters are avoided. This can be rendered possible by virtue of the incorporation of the nonreturn (NRV) function in the head (in a second valve which connects removably to the valve 1) rather than in the residual pressure valve shutter 8 as is customary. This is also obtained by controlling the position of the piston of the dust valve shutter 8 that acts as a residual pressure valve (RPV) shutter and via the external members (valve driver stem 23 . . . ). The absence of dynamic sealing (the seal 123 is preferably static) also makes it possible to reduce the aforementioned problems (whistling and/or friction).

In the event that a second valve is coupled to the first valve 1 in order to perform withdrawals of/fillings with gas, the residual pressure valve function is therefore present on the first valve 1 by virtue of the dust valve shutter 8 as described above. When the valves of the first valve are open with a view to withdrawal, the residual pressure valve shutter function can be performed by another residual pressure valve shutter housed in the second valve in fluidic communication with the circuit of the first valve. That makes it possible to prevent an oscillator in the system going into resonance.

During filling, the two residual pressure valves are neutralized. Specifically, the dust valve shutter 8 is automatically overridden, avoiding problems associated with the manual operations (the switching of levers for example).

It will be understood that many additional changes in the details, materials, steps and arrangement of parts, which have been herein described in order to explain the nature of the invention, may be made by those skilled in the art within the principle and scope of the invention as expressed in the appended claims. Thus, the present invention is not intended to be limited to the specific embodiments in the examples given above.

What is claimed is:

1. A valve comprising a body delimiting an internal fluid withdrawal, an internal circuit extending between an upstream end configured to be placed in communication with the storage volume of a tank and a downstream end configured to be connected to a user member withdrawing or distributing pressurized fluid via the internal circuit, the valve comprising, placed in series from upstream to downstream in the internal circuit between the upstream end and the downstream end: an upstream valve shutter, an isolation valve shutter and a dust valve shutter, the dust valve shutter configured to move relative to the body between a position in which the upstream end of the circuit is closed and at least two distinct open positions, when the dust valve shutter is in the closed position, the isolation valve shutter and the upstream valve shutter being in respective positions in which the circuit is closed, in the at least two respective distinct open positions of the dust valve shutter, either only the isolation valve shutter being in a position in which the circuit is open or, respectively, the isolation valve shutter and the upstream valve shutter being in positions in which the circuit is open, wherein the valve comprises a calibrated orifice defining a determined opening allowing gas to pass between upstream and downstream of the upstream valve shutter when the latter is in the position in which the circuit is closed, said determined opening of the calibrated orifice being smaller than an opening produced when the upstream valve shutter is in the position in which the circuit is open, wherein the calibrated orifice comprises a shutter bearing non-sealingly on the seat.

2. The valve according to claim 1, wherein the calibrated orifice delimits an opening having a first determined cross section whereas the opening produced when the upstream valve shutter is in the position in which the circuit is open has a second determined cross section and in that the ratio between the first cross section and the second cross section is between 1/100 and 1/20.

3. The valve according to claim 1, wherein the isolation valve shutter moves relative to a seat between a downstream position in which the circuit is closed and at least one upstream position in which the circuit is open, the isolation valve shutter being urged towards the downstream position by a return member, the dust valve shutter comprising an upstream end and configured to move relative to the body between a downstream position in which the upstream end of the circuit is closed and at least one upstream position in which the downstream end of the circuit is open, the said dust valve shutter being urged towards the downstream position by a return member, the upstream valve shutter configured to move relative to a seat between a downstream position in which the circuit is closed and at least one upstream position in which the circuit is open, the upstream valve shutter being urged towards the downstream closed position by a return member.

4. The valve according to claim 3, wherein the dust valve shutter moves from the downstream closed position towards: a first determined upstream position referred to as the "contactless" position opening the downstream end of the circuit, in which position the downstream end of the dust valve shutter does not push against the isolation valve shutter, or a second determined upstream position referred to as the "contacting" position opening the downstream end of the circuit, in which position the upstream end of the dust valve shutter pushes on a downstream end of a mobile isolation valve shutter in order, through contact, to move the isolation valve shutter off the seat towards a first upstream position in which the circuit is open in which position the isolation valve shutter does not push on the upstream valve shutter, or a third determined upstream position opening the downstream end of the circuit, in which position the upstream end of the dust valve shutter pushes on a downstream end of the mobile isolation valve shutter to move the isolation valve shutter off the seat towards a second upstream position in which the circuit is open, in which position the isolation valve shutter pushes the upstream valve shutter into the position in which the upstream end of the circuit is open.

5. The valve according to claim 1, wherein the calibrated orifice is delimited at least in part by the upstream valve shutter or an element thereof.

6. The valve according to claim 1, wherein the calibrated orifice is housed in the upstream valve shutter.

7. The valve according to claim 1, wherein the dust valve shutter is a residual pressure valve shutter maintaining a minimum pressure in the circuit when it is in the closed position and allowing gas to be discharged from the circuit in the event of an overpressure above a determined pressure threshold.

8. The valve according to claim 7, further comprising a deformable seal situated on the dust valve shutter and/or on the body and able and configured for excess pressure in the circuit above a determined threshold to be discharged to the outside, but remaining in a closed and sealed position when the pressure in the circuit is below this threshold.

* * * * *